United States Patent [19]

de Vries

[11] Patent Number: 5,035,574

[45] **Date of Patent: * Jul. 30, 1991**

[54] PUMP HOUSING, MOULD PARTS OF A MOULD WALL FOR A PUMP HOUSING AND METHOD OF MANUFACTURING A PUMP HOUSING

[75] Inventor: Gerrit de Vries, Hengelo, Netherlands

[73] Assignee: Stork Pompen BV, Hengelo, Netherlands

[ * ] Notice: The portion of the term of this patent subsequent to Sep. 26, 2006 has been disclaimed.

[21] Appl. No.: 394,478

[22] Filed: Aug. 16, 1989

Related U.S. Application Data

[62] Division of Ser. No. 518,676, Jul. 29, 1983, Pat. No. 4,869,643.

[30] Foreign Application Priority Data

Aug. 12, 1982 [NL] Netherlands ..... 8203179

[51] Int. Cl.[5] ..... F04D 29/40

[52] U.S. Cl. ..... 415/200; 415/214.1; 417/423.14; 52/583

[58] Field of Search ..... 415/200, 214.1, 1, 164, 415/71; 417/423.14; 52/21, 224, 583; 29/889.22; 416/176

[56] References Cited

U.S. PATENT DOCUMENTS

| | | | |
|---|---|---|---|
| 841,496 | 1/1907 | Fargo | 415/200 |
| 1,107,591 | 8/1914 | De Huff | 415/200 |
| 1,254,417 | 1/1918 | Leonard | 52/583 |
| 1,608,259 | 11/1926 | Taylor | 415/200 |
| 2,687,280 | 8/1954 | Sharp | 415/164 |
| 4,792,282 | 12/1988 | Jordan | 415/71 |
| 4,869,643 | 9/1989 | De Vries | 415/200 |

FOREIGN PATENT DOCUMENTS

| | | | |
|---|---|---|---|
| 735684 | 11/1932 | France . | |
| 81164 | 5/1962 | Japan | 415/1 |

*Primary Examiner*—John T. Kwon

*Attorney, Agent, or Firm*—Watson, Cole, Grindle & Watson

[57] ABSTRACT

A pump housing, for pumps of high yield and low lift, has a suction casing, a suction mouth and a volute arranged in the concrete substructure of a pump station. The volute is made by assembling thin-walled mould wall parts, mounting them in place, and thereafter casting fresh concrete around the resulting mould wall, thereby ensuring that reinforcing elements of the mould wall are connected with reinforcing elements of the concrete to be cast. The suction casing and suction mouth are preferably made in the same way. Thus, the use of complicated casings for casting concrete elements can be avoided.

16 Claims, 3 Drawing Sheets

Figure 2:
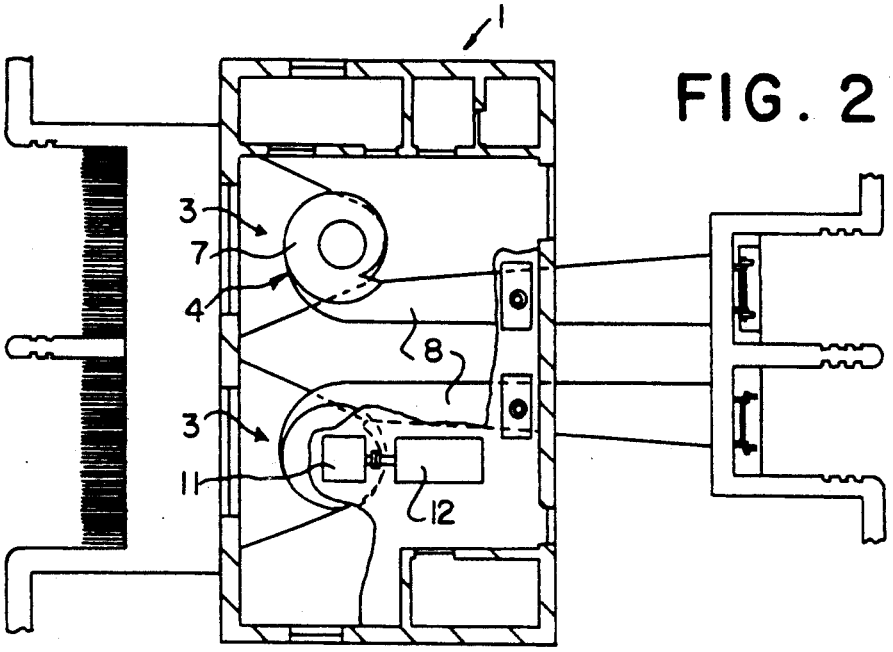

PUMP HOUSING, MOULD PARTS OF A MOULD WALL FOR A PUMP HOUSING AND METHOD OF MANUFACTURING A PUMP HOUSING

This application is a divisional application of application Ser. No. 518,676, filed July 29, 1983, now patented U.S. Pat. No. 4,869,643.

This invention relates to a pump housing which has a suction casing, a suction mouth and a volute of concrete arranged in a concrete substructure of a pump station.

Such a pump housing is known in the art and is employed for pumps of high yield and relatively low lift, for example, condenser cooling water circulation pumps, main docks pumps, irrigation and draining pumps, crude water takeup pumps for drinking water supplies, and effluent outlet pumps in sewerage purification plants. Such a pump housing has the advantage that it is corrosion-resistant. However the casing required for casting the concrete is complicated and expensive due to the complicated form of the volute and can be used only once. Moreover the manufacture of the casing and the removal thereof after cure of the concrete are timeconsuming operations.

The invention has for its object to provide a concrete pump housing, which is free of said disadvantages. According to the invention this is achieved by providing the pump housing with a prefabricated, thin-walled volute mould wall of reinforced concrete, which mould wall is embedded in the concrete of the concrete substructure.

The invention further provides mould wall parts for assembling a mould wall of a pump housing of the invention arranged in the concrete substructure of a pump station. The dimensions and the weight of the mould wall parts are determined by the requirements of transportability and ease of handling during mounting operations. Therefore, the largest width should preferably not exceed 2.50 meters and the weight should not be more than 5000 kgs a piece. The wall thickness of the mould wall parts is such that the mould wall can resist the pressure of the concrete to be cast for completion of the concrete construction. The order of magnitude of the wall thickness may be about 10 cms. Such mould wall parts can be simply manufactured with the aid of re-usable moulds in a manner known per se in concrete constructions.

In pump stations comprising a plurality of identical pumps the expensive and time-consuming manufacture of casings for volutes thus avoided and, in addition, an identical and accurate design of the volute is ensured, which is particularly important for the hydraulic properties of the pumps. A further advantage resides in fact that the mould wall parts, which will contact the medium to be pumped with their inner sides, can be made from high-quality concrete, whereas the remainder of the concrete construction may be of a different quality.

The invention further provides a method for the manufacture of a pump housing, as will be apparent from the following description.

The invention will now be described in more detail with reference to the drawings which are given by way of example and should not be considered to be limitative for the various embodiments of a pump housing construction in accordance with the invention.

Figure 1:
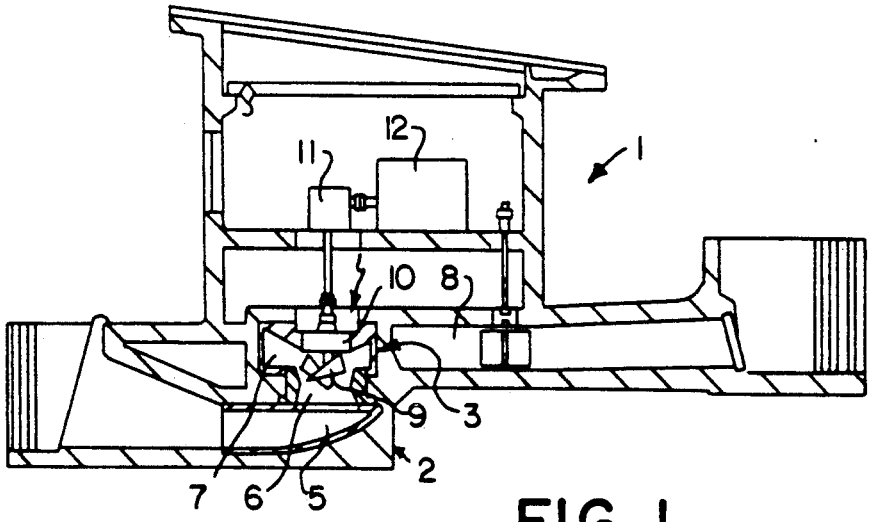
Figure 7:
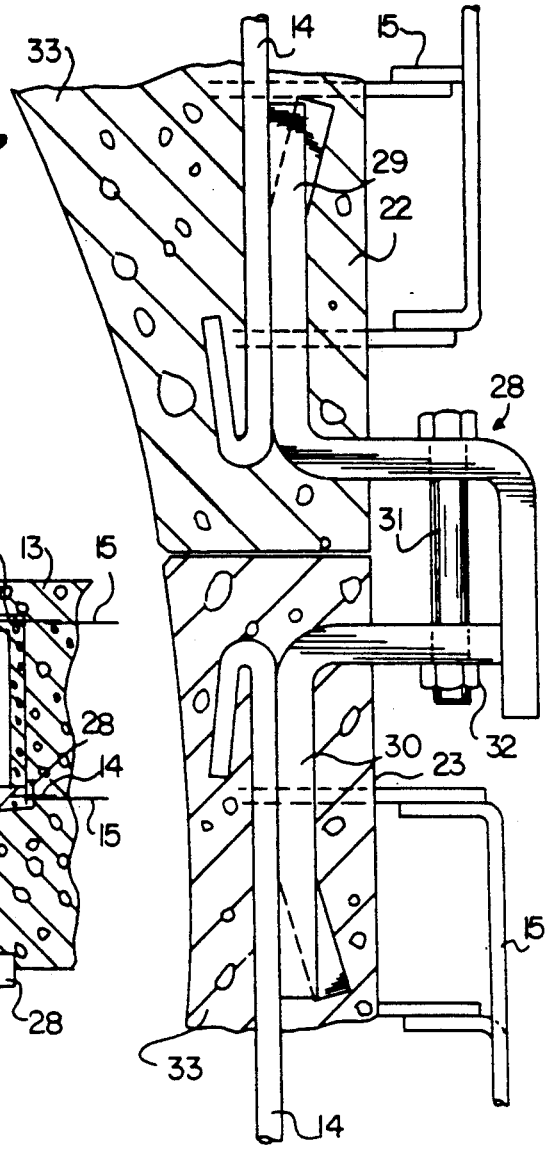
Figure 3:
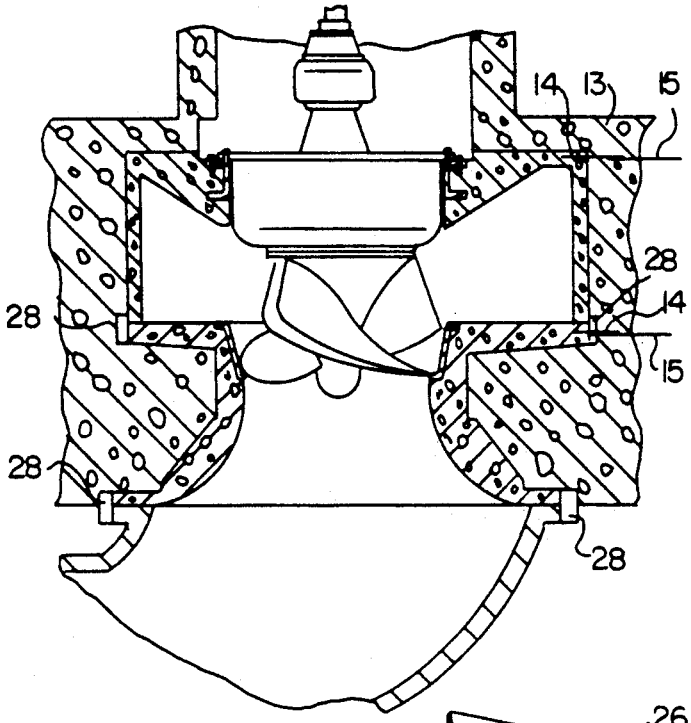
Figure 8:
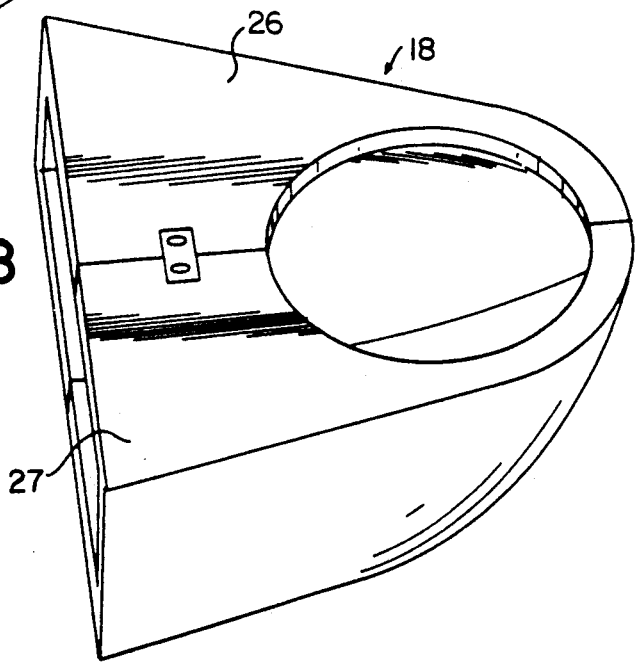
Figure 4:
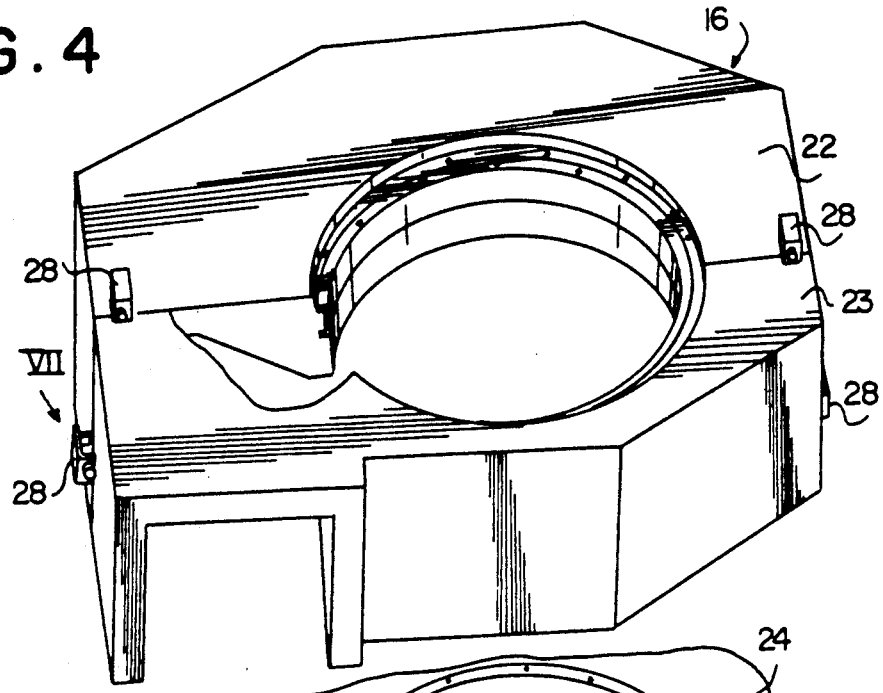
Figure 6:
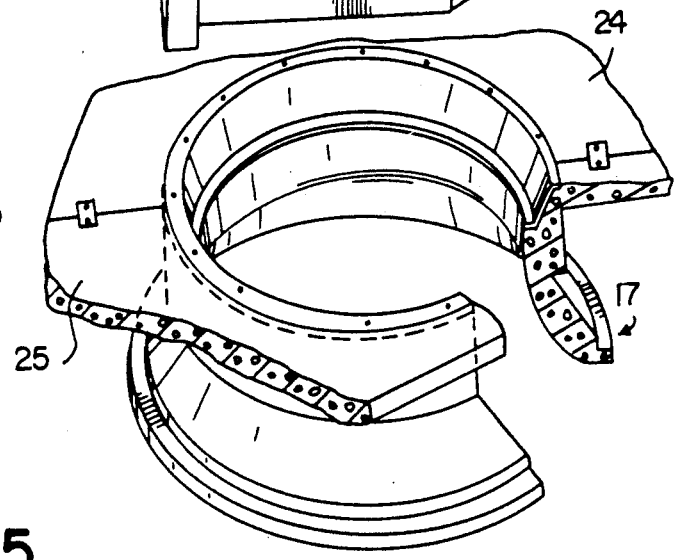
Figure 5:
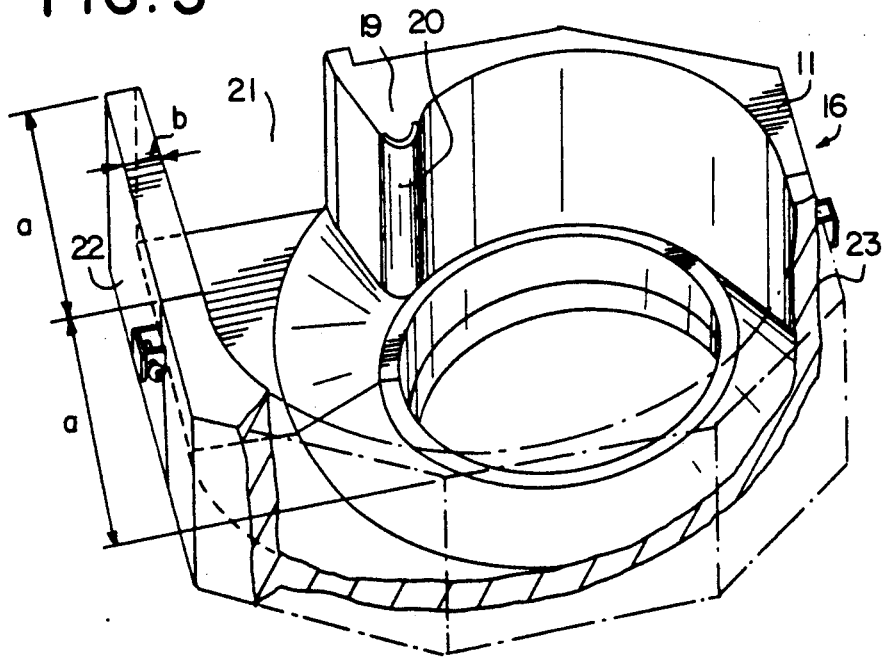

The drawings show in:

FIGS. 1 and 2 a vertical and a horizontal sectional view respectively of a pump station comprising two pump housings embodying the invention, FIG. 3 is a vertical sectional view of a pump and a pump housing of FIG. 1, FIGS. 4 and 5 a perspective plan view and a bottom view respectively of a volute mould wall of the pump housing of FIG. 1, FIG. 6 a fragmentary, perspective plan view of a suction mouth mould wall of a pump housing of FIG. 1, FIG. 7 on an enlarged scale tie means for interconnecting mould wall parts in the direction of arrow VII in FIG. 4, and FIG. 8 a perspective view of a suction casing mould wall of a pump housing of FIG. 1.

The pump station 1 of FIGS. 1 and 2 has a concrete substructure 2 comprising two identical pump housings 3 for pumps 4.

This pump station 1, for example of a draining 15 mill, comprises pumps 4 of large dimensions having a high yield with a low lift. Each pump 4 has a pump housing 3 comprising a suction casing 5, a suction mouth 6, a volute 7 and an effluent channel 8. A rotating impeller 9 is mounted in the pump housing by means of a bearing 10. The impeller 9 is driven by a motor 12 via driving gear 11.

In the manufacture of the pump housing 3, at least the volute 7, but preferably the suction mouth 6 and the suction casing 5 as well, are prefabricated in parts. Mould wall parts defining the space traversed by the fluid and serving, in addition, as lost casing elements are prefabricated first and are then assembled and mounted in place. Thereupon they are embedded in the concrete 13 of the substructure 2, after ensuring that reinforcing elements 14 of the mould walls are connected with reinforcing elements 15 of the remaining substructure 2.

The following mould wall parts are shown:

a volute mould wall 16 in FIGS. 4 and 5, a suction mouth mould wall 17 in FIG. 6, and a suction casing mould wall 18 in FIG. 8.

The volute mould wall 16 has internally the shape of a volute, a tongue 19 thereof being lined with a metal tongue element 20. The volute has furthermore an effluent piece 21. In a different embodiment other metal parts such as a foundation cover may be embedded.

The volute mould wall 16 comprises two mould wall parts 22 and 23, which are readily transportable, for example, along the road, and for this purpose they have a width a of 2.5 meters or less. Moreover the weight of these mould wall parts 22 and 23 does not exceed 5000 kgs so that they can still be handled by simple lift and transport means. The wall thickness b of the mould wall parts 22 and 23 is limited to, for example, 10 cms, which is sufficient to resist the pressure of the concrete 13 of the substructure 2 to be cast after the volute mould wall 16 has been mounted. The suction mouth mould wall 17 and the suction casing mould wall 18 each comprise two mould wall parts 24, 25 and 26, 27 respectively.

The mould wall parts 22, 23, 24, 25, 26, 27 are interconnected in pairs, i.e. pulled one against the other with the aid of tie means 28 (FIG. 7) formed by steel brackets 29 and 30 welded to reinforcing elements 14 of the mould wall parts and drawn towards one another by means of a bolt 31 and a nut 32.

The volute mould wall 16, the suction mouth mould wall 17 and the suction casing mould wall 18 are all assembled by means of such tie means.

Reinforcing elements 14 projecting out of the concrete 33 of the mould wall parts 22 to 27 are connected with reinforcing elements 15 for the concrete 13 of the concrete substructure 2. Thereupon, concrete 13 is cast around the mould wall parts 22 to 27 to complete the concrete substructure 2. The location of the partitions in the mould walls is arbitrary both in a horizontal and in a vertical plane. Therefore, such partitions may be different from those shown herein.

What I claim is:

1. A pump installation comprising the combination of:

a suction casing having a horizontal upper wall defining a supporting surface and other wall portions defining an inlet mouth, said upper wall having an opening therein;

a suction mouth housing having an upright body supported on said supporting surface of said suction casing, said body defining a suction mouth at its lower end aligned with and forming a continuation of said opening in the upper wall of said suction casing, said body defining an upper mouth at its upper end and being provided with a horizontal wall surrounding said upper mouth and presenting an upper supporting surface;

a volute housing having an upstanding volute wall defining a horizontally facing discharge mouth, the lower edge of said volute housing being supported on said supporting surface of the suction mouth housing, and said volute housing having a horizontal wall joined to the upper edge of said volute wall and defining, in conjunction with said volute wall and said supporting surface of the suction mouth housing, a volute chamber adapted to receive a pump impeller;

at least the volute housing being a thin-walled, prefabricated structure made of reinforced concrete; and a concrete substructure completely surrounding, in contact with and wholly embedding said volute housing, the underlying suction mouth housing supporting it and the underlying suction casing upon which the suction mouth housing is supported.

2. A pump installation as defined in claim 1 wherein each of said suction casing and suction mouth housing is also a thin-walled, prefabricated structure made of reinforced concrete.

3. A pump installation as defined in claim 2 wherein each of said suction casing, said suction mouth housing and said volute housing is made of separable sections and provided with means for holding said sections in proper alignment with each other and for connection to reinforcing rods in said substructure.

4. A pump installation as defined in claim 2 wherein the thickness of said walls is about 10 cms.

5. A pump installation comprising the combination of:

a suction casing having a horizontal upper wall defining a supporting surface and other wall portions defining an inlet mouth, said upper wall having an opening therein;

a suction mouth housing having an upright tubular body supported on said supporting surface of said suction casing, said tubular body defining a suction mouth at its lower end aligned with and forming a continuation of said opening in the upper wall of said suction casing, said tubular body defining a upper mouth at its upper end and being provided with a horizontal wall surrounding said upper mouth and presenting an upper supporting surface;

a volute housing having an upstanding volute wall defining a horizontally facing discharge mouth, the lower edge of said volute being supported on said supporting surface of the suction mouth housing, and said volute housing having a horizontal wall joined to the upper edge of said volute wall and defining, in conjunction with said volute wall and said supporting surface of the suction mouth housing, a volute chamber adapted to receive a pump impeller, at least the volute being a thin walled, prefabricated structure made of reinforced concrete; and a concrete substructure surrounding, in contact with an embedding said volute housing, the underlying suction mouth housing supporting it and the underlying suction casing upon which the suction mouth housing is supported, said concrete substructure extending up to a higher level than the volute housing.

6. A pump installation according to claim 5, wherein said volute housing is made of high quality concrete, whereas the surrounding concrete is made of a different quality.

7. A pump installation according to claim 5 including mounting means for a rotatable impeller, said mounting means being embedded int eh concrete of said volute housing.

8. A pump installation according to claim 5, including a metal tongue embedded in the concrete of said volute housing.

9. A pump installation according to claim 5 wherein said suction mouth comprises a thin walled suction mould wall, an impeller supported within said suction mouth, and a ring embedded within said suction mould wall and facing said impeller.

10. A pump installation according to claim 5 wherein the volute chamber includes a side, a bottom and a top, the side of the volute chamber being defined by an inner surface, said inner surface comprising a spiral-shaped upright wall having upright straight lines, the bottom of said chamber being defined by a bottom flat horizontal surface, the top of the chamber being defined by a surface of frusto-conical configuration.

11. A pump installation comprising the combination of:

a suction casing having a horizontal upper wall defining a supporting surface and other wall portions defining an inlet mouth, said upper wall having an opening therein;

a suction mouth housing having an upright tubular body supported on said supporting surface of said suction casing, said tubular body defining a suction mouth at its lower end aligned with and forming a continuation of said opening in the upper wall of said suction casing, said tubular body defining a upper mouth at its upper end and being provided with a horizontal wall surrounding said upper mouth and presenting an upper supporting surface;

a volute housing having an upstanding volute wall defining a horizontally facing discharge mouth, the lower edge of said volute being supported on said supporting surface of the suction mouth housing, and said volute housing having a horizontal wall joined to the upper edge of said volute wall and defining, in conjunction with said volute wall and said supporting surface of the suction mouth housing, a volute chamber adapted to receive a pump impeller, at least the volute housing being a thin walled, prefabricated structure made of reinforced concrete; and a concrete substructure surrounding, in contact with an embedding said volute housing, said concrete structure extending up to a higher level than the volute housing.

12. A pump installation according to claim 11, wherein said volute housing is made of high quality concrete, whereas the surrounding concrete is made of a different quality.

13. A pump installation according to claim 11 including mounting means for a rotatable impeller, said mounting means being embedded in the concrete of said volute housing.

14. A pump installation according to claim 11, including a metal tongue embedded in the concrete of said volute housing.

15. A pump installation according to claim 11 wherein said suction mouth comprises a thin walled suction mould wall, an impeller supported within said suction mouth, and a ring embedded within said suction mould wall and facing said impeller.

16. A pump installation according to claim 11 wherein the volute chamber includes a side, a bottom and a top, the side of the volute chamber being defined by an inner surface, said inner surface comprising a spiral-shaped upright wall having upright straight lines, the bottom of said chamber being defined by a bottom flat horizontal surface, the top of the chamber being defined by a surface of frusto-conical configuration.

* * * * *